US005556295A

United States Patent [19]

McFadden et al.

[11] Patent Number: 5,556,295

[45] Date of Patent: Sep. 17, 1996

[54] MODULAR PLUG LOCKING SYSTEM

[75] Inventors: William C. McFadden, La Canada; Stanley D. Tout, Arcadia, both of Calif.

[73] Assignee: Dynametric, Inc., Monrovia, Calif.

[21] Appl. No.: 390,095

[22] Filed: Feb. 17, 1995

[51] Int. Cl.[6] ..... H01R 13/639

[52] U.S. Cl. ..... 439/301; 379/438; 439/304; 439/353

[58] Field of Search ..... 439/301, 304, 439/353, 354, 344; 379/438, 445

[56] References Cited

U.S. PATENT DOCUMENTS

| | | | |
|---|---|---|---|
| 4,211,462 | 7/1980 | Wolfthal | 439/460 |
| 4,647,726 | 3/1987 | Blum | 439/352 |
| 4,862,500 | 8/1989 | May | 379/445 |
| 4,870,840 | 10/1989 | Klein | 70/57 |
| 4,946,404 | 8/1990 | Takenouchi et al. | 439/352 |
| 5,119,419 | 6/1992 | McDaid | 379/438 |
| 5,305,380 | 4/1994 | Hileman et al. | 379/445 |

*Primary Examiner*—Neil Abrams
*Attorney, Agent, or Firm*—Benoit Law Corporation

[57] ABSTRACT

A modular plug is locked in a modular receptacle by a frangible locking member disintegral from such modular plug. An internal first catch on that frangible locking member catches an inside of the modular receptacle. The internal first catch is rendered inaccessible from outside the modular receptacle when the frangible locking member and the modular plug are in place in that modular receptacle. A second catch on the frangible locking member detains the modular plug in the modular receptacle until the frangible locking member has been broken up. A device for locking a modular plug in a modular receptacle has a locking member disintegral from such modular plug and having a frangible head. A pair of spaced flexible prongs project from such head. A catch on each of such flexible prongs is spaced from the frangible head and a third or middle prong projects from the head between the pair of spaced flexible prongs.

42 Claims, 2 Drawing Sheets

MODULAR PLUG LOCKING SYSTEM

FIELD OF THE INVENTION

The subject invention relates to electrical plug-in kind of connectors of a modular type, and to methods and devices for locking a modular plug in a modular receptacle against unauthorized or undetectable removal.

BACKGROUND

By way of contrast, proposals for locking a plug-in kind of electrical receptacle against unauthorized access by an electrical connector plug are well known. Reference may by way of example be had to U.S. Pat. No. 4,862,500, for Telephone Jack Lock-Out Plug, by Donald M. May, issued Aug. 29, 1989, U.S. Pat. No. 4,870,840, for Modular Communications Jack Lock, by Edward Klein, issued Oct. 3, 1989, and U.S. Pat. No. 5,305,380, for Methods And Apparatus For Providing A Secure Telecommunications Port, by Vincent Hileman et al, issued Apr. 19, 1994.

Reference may also be had to U.S. Pat. No. 4,211,462, for Electrical Connector For Termination Cords With Improved Locking Means, by Maurice Wolfthai, issued Jul. 8, 1980.

Of course, modular plugs and jacks or receptacles have entered practically every home and office, since telephone companies and electrical and electronic data processing, recording and other equipment manufacturers started equipping their apparatus with modular plugs, some of which are mentioned, described or shown in the above mentioned patents and in other literature as well.

As is well known, and as is readily verifiable from any modern phone, modular telephone-type plugs have an integral resilient latch that catches a pair of internal projections in the modular jack or receptacle, thereby removably retaining that plug in its receptacle for establishment and maintenance of electrical and electronic connections.

Traditionally, such latches are provided with tabs that project out of the receptacle when the plug has been inserted therein, and that are readily engageable by fingernails for easy removal of modular plugs from their modular receptacles by manual depression and disengagement of the resilient latch from the modular receptacle.

However, the price being paid for such connect-disconnect ease and convenience has included tampering with telephones and other electronic equipment by more or less playful kids and other undesired interference, theft of telephone handsets and of entire telephone apparatus from hotel rooms and other locations.

Removal of the projecting tab from the resilient latch by the manufacturer or initial user would discourage the most obvious kind of intrusion, but could not effectively hinder any person that can handle a pin, penknife, nailfile, miniature screwdriver or similar implement from reaching and depressing the integral resilient latch on the modular plug through part of the regular opening of the receptacle, thereby readily removing the plug from its receptacle despite an apparent safety.

This exposes modular plug interconnections and the apparatus connected thereto and the systems served thereby to dangers other than just theft of equipment.

For instance, some personnel charged with answering incoming phone calls occasionally attempt to lighten their load by simply pulling the modular plug from their telephone apparatus. That can be done more surreptitiously than removing the headset from the telephone apparatus and putting it next to the phone, and is harder to detect by a supervisor.

Abuse also occurs in certain tasks that involve a monitoring or recording of phone conversations or other transmissions, such as in emergency centers, insurance companies, consumer service facilities or in many other areas or circumstances.

For instance, some personnel have disconnected a recording or monitoring device temporarily by removing its modular plug so that personal phone calls, rude encounters with a customer or other caller, unauthorized breaks, and other incidents will not be recorded or detected by the monitor or supervisor.

In busy work situations, such abuses are difficult and often impossible to detect and to correct, if personnel can simply remove a modular plug either with the aid of a fingernail or a pin, miniature screwdriver, nailfile, or other implement, and if the removed modular plug thereafter can be reinserted undetectable, as if nothing had happened.

SUMMARY OF THE INVENTION

The invention resides in a device for locking a modular plug in a modular receptacle, comprising, in combination, a frangible locking member disintegral from the modular plug, an internal first catch on the frangible locking member adapted to catch an inside of the modular receptacle, such internal first catch being inaccessible from outside the modular receptacle when the frangible locking member and the modular plug are in place in the modular receptacle, and a second catch on the frangible locking member adapted to detain the modular plug in the modular receptacle until the frangible locking member has been broken up.

The invention resides also in a device for locking a modular plug in a modular receptacle, comprising, in combination, a frangible locking member disintegral from the modular plug, a pair of internal first catches on the frangible locking member adapted to catch the modular receptacle inside thereof, such internal first catches being inaccessible from outside the modular receptacle when the frangible locking member and the modular plug are in place in the modular receptacle, and a second catch on the frangible locking member is adapted to detain the modular plug in the modular receptacle until the frangible locking member has been broken up.

The invention resides also in a device for locking a modular plug in a modular receptacle, comprising, in combination, a locking member disintegral from the modular plug and having a frangible head, a pair of spaced flexible prongs projecting from the head, a catch on each of the flexible prongs spaced from the frangible head, and a third prong projecting from the head between the pair of spaced flexible prongs.

The invention resides also in a method of locking a modular plug in a modular receptacle, comprising, in combination, providing a frangible locking member disintegral from the modular plug, providing an internal first catch on the frangible locking member for catching an inside of the modular receptacle, rendering the internal first catch inaccessible from outside the modular receptacle when the frangible locking member and the modular plug are in place in the modular receptacle, providing a second catch on the frangible locking member for detaining the modular plug in the modular receptacle until the frangible locking member has been broken up.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figure 3:
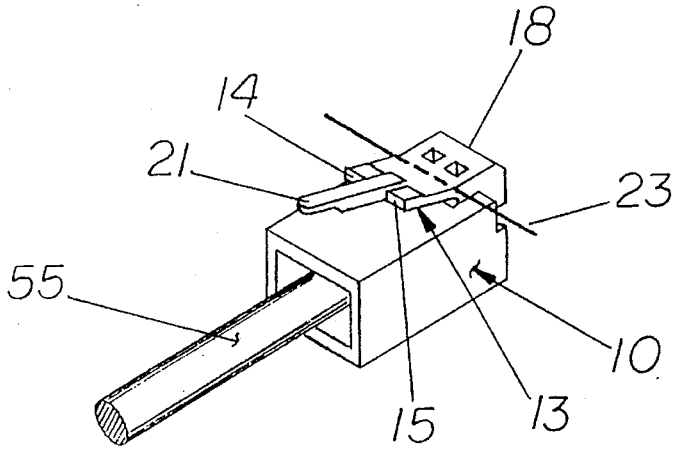
FIG. 3 is a perspective illustration of a standard modular plug and of a method of modification thereof pursuant to an embodiment of the invention.

FIGS. 1, 4, 5 and 6 show devices for locking a modular plug 10 in a modular jack or receptacle 12. The modular plug may be manufactured for present purposes or may be adapted from a standard modular plug. In this respect, while FIG. 3 illustrates part of a method according to an embodiment of the subject invention, such FIG. 3 incidentally also depicts the familiar standard modular plug of a type manufactured with a resilient latch 13 having projections 14 and 15 for catching internal projections 16 and 17 in the modular receptacle 12. As is well known, such resilient latch 13 has a base 18 integral with the modular plug 10.

Pursuant to a preferred embodiment of the invention, such standard modular plug is prevented from staying in a standard modular receptacle 12 without the presence of a locking member 20 according to the invention.

It may be recalled from the above background description that latches 13 of standard modular plugs traditionally have been provided with a tab 21 that will project out of a standard receptacle 12 when the plug has been inserted therein. Such tabs 21 are a convenience in standard modular plug arrangements, since they are readily engageable by fingernails for easy removal of modular plugs from their modular receptacles by manual depression resulting in disengagement of the resilient latch from the catch or projections 16 and 17 in the modular receptacle. However, that is exactly what the subject invention wants to avoid for reasons including those mentioned above.

It may also be recalled from the above background description that removal of the projecting tab 21 from the resilient latch 13 by the manufacturer or initial user would discourage the most obvious kind of intrusion, but could not effectively hinder any person that can handle a pin, penknife, nailfile, miniature screwdriver or similar implement from reaching and depressing the integral resilient latch 13 on the modular plug through part of the regular opening of the receptacle, thereby readily removing the plug from its receptacle despite an apparent safety.

Accordingly, pursuant to the preferred embodiment of the invention illustrated in FIG. 3, the modular plug 10 is prevented from staying in a standard modular receptacle 12 without the presence of a locking member 20 according to the invention.

Figure 2:
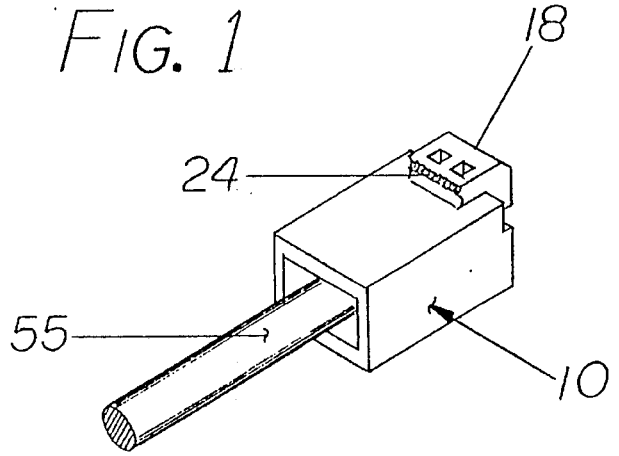
FIG. 2 is a perspective view of a modular plug modified according to an embodiment of the invention for use in the connector arrangement shown in FIG. 1, 4, 5 or 6.
Figure 4:
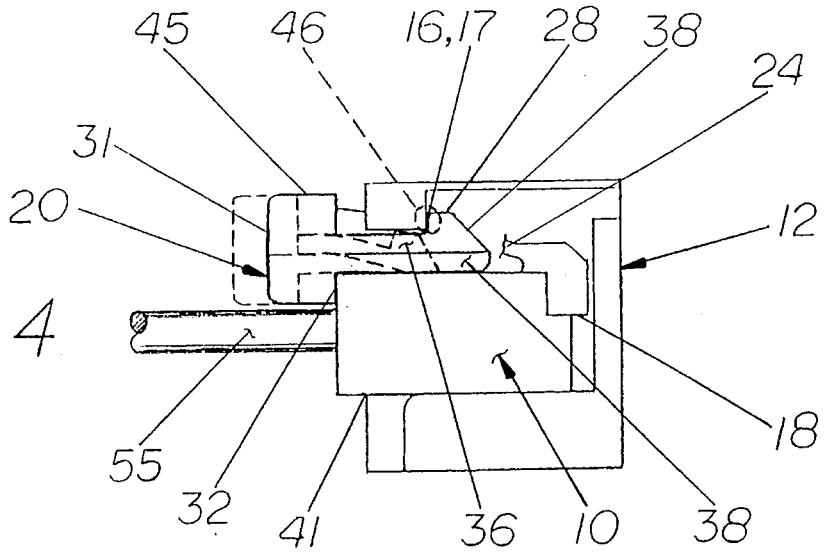
FIG. 4 is aside view of the modular connector arrangement according to an embodiment of the invention, with a side wall of the modular receptacle removed for better visibility.
Figure 5:
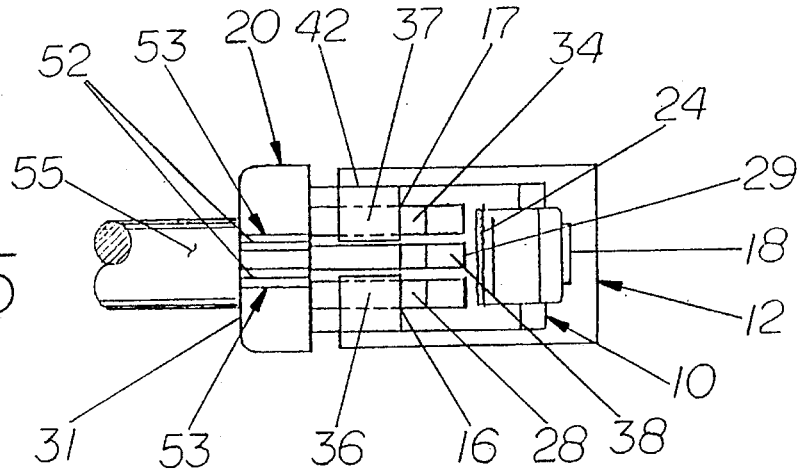
FIG. 5 is a top view of the modular connector arrangement showing a locking device according to a preferred embodiment of the invention.

In practice, this may be accomplished by either not providing the latch 13 on the modular receptacle 10 when it is manufactured, or by removing the resilient latch 13 from such standard modular plug as manufactured conventionally. Such removal may be accomplished by cutting or scoring the resilient latch 13, such as indicated by a phantom line 23 in FIG. 3 and by bending the scored latch back and forth until it breaks off, leaving the base 18 with a facing 24 on the modular plug 10, such as shown in FIGS. 2, 4 and 5. Such facing may be ragged, if the standard latch 13 is removed according to the method illustrated in FIG. 3. On the other hand, within the scope of the invention the projection 18 may be provided without a latch 13 when the modular plug is manufactured, in which case the facing 24 may for instance be smooth.

The word "omitting" is herein used to encompass both situations wherein a latch 13 is not provided to start with, and situations wherein a provided latch 13 is removed.

At any rate, if an unauthorized person breaks the frangible locking member 20 in order to remove the modular plug 10 from its receptacle 12, such plug will not be able to stay in its receptacle when reinserted therein without a fresh locking member 20, since it does not have a latch 13. The supervisor who alone has fresh locking members, will thus readily see that a breach has occurred.

Figure 1:
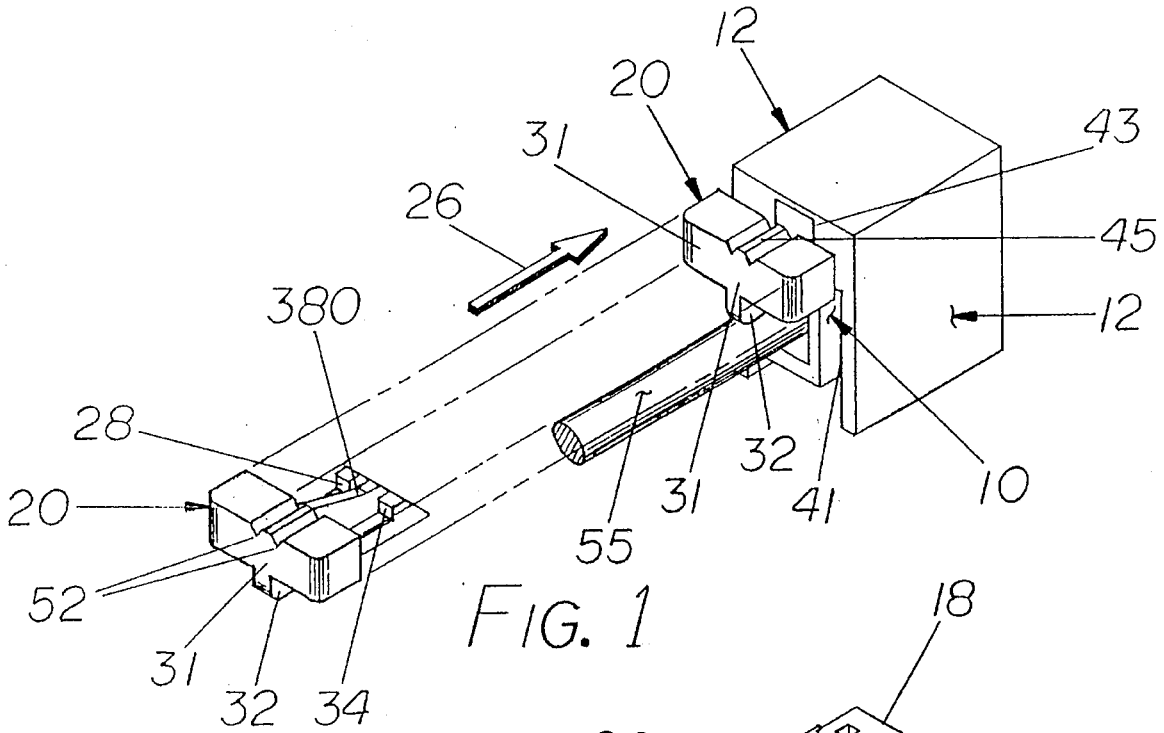
FIG. 1 is a perspective view of a modular connector arrangement with locking device according to an embodiment of the invention both prior and after insertion in between the modular plug and its modular receptacle.

An example of a device 20 for locking a modular plug 10 in a modular receptacle 12 according to an embodiment of the invention is seen in FIG. 1.

That device in effect is a frangible locking member 20 disintegral from the modular plug. By way of background, FIG. 3 shows that the standard latch 13 is integral with a standard modular plug through the latch base 18. Contrary to that traditional prior-art practice, the locking member 20 according to the subject invention is disintegral from the modular plug 10, which is just the opposite of integral.

In this respect, FIG. 1 shows a locking member both before insertion into the modular receptacle and after movement in the direction of arrow 26 and insertion in between the modular receptacle 12 and the modified modular plug 10 therein. In brief, FIG. 1 shows that the locking member 20 according to an embodiment of the invention is provided separate or disintegral from the modular plug 10, as opposed to the unified or integral provision of the conventional latch 13 that is omitted or deleted according to the subject invention.

The invention also provides an internal first catch 28 and/or 34 on the frangible locking member 20. That first catch is herein called "internal," since it is positioned or adapted to catch an inside of the modular receptacle 12, such as at projections 16 and/or 17 of that receptacle. Unlike prior-art arrangements that can be thwarted by a pin, penknife, nailfile, miniature screwdriver or other implement or tool, the internal first catch 28 remains inaccessible from the outside of the modular receptacle when the frangible locking member 20 and the modular plug 10 are in place in that modular receptacle 12, such as shown in FIGS. 1 and 4 to 6.

According to embodiments of the invention, it is the frangible locking member 20 that renders the internal first catch 28 and/or 34 inaccessible from outside the modular receptacle when that frangible locking member and the modular plug 10 are in place in that modular receptacle 12.

The subject invention also provides a second catch on the frangible locking member 20 for detaining the modular plug 10 in the modular receptacle 12 until that frangible locking member has been broken up.

While the first catch 28 and/or 34 has been called "internal" as mentioned above, the second catch is not so designated, since there are several ways within the scope of the invention in which a second catch on the frangible locking member may be adapted to detain the modular plug 10 in the modular receptacle 12 until that frangible locking member 20 has been broken up.

For instance, FIG. 5 shows a catch 29 that qualifies as a second catch within the scope of the invention, since it blocks the modular plug 10 at facing 24 of its projection 18.

In particular, in a method or device for locking a modular plug 10 having a projection 18 in the modular receptacle 12, the second catch 29 may be provided to restrain or block that modular plug at that projection, such as at its facing 24, until the locking member 20 is broken up. For example, if the modular plug was manufactured with an integral latch 13 that was broken off from its base, such as described above by reference to FIGS. 2 and 3, then the second catch 29 may be provided to block that modular plug 10 at the base 18 of the broken-off resilient latch integral with that modular plug from removal from the modular receptacle 12 until the frangible locking member 20 has been broken up.

Such second catch 29 may be called "internal" like the first catch 28 and/or 34, since it is positioned or adapted to catch a projection inside of the modular receptacle 12, such as the projection 18 at facing 24 of the modular plug 10.

Alternatively or additionally, the frangible locking member 20 may be provided with an external portion or head 31 which will be overhanging the modular plug 10 when such modular plug is in the modular receptacle 12. Such an overhang 32 may qualify as a second catch within the scope of the subject invention, inasmuch as the modular plug 10 cannot move or be moved out of its receptacle 12 until the frangible locking member 20 has been broken up and the overhang or projection 32 has been removed from the face of the modular plug.

Embodiments of the invention thus may have one or more second catches 29 and 32 so to speak. Embodiments of the invention also may have one or more first catches in combination with one or more second catches.

In particular, FIG. 5 shows a device for locking a modular plug in a modular receptacle comprising a frangible locking member 20 being also disintegral from that modular plug and having a pair of internal first catches 28 and 34 on that frangible locking member adapted to catch that modular receptacle inside thereof, such as at spaced projections 28 and 34, respectively.

Such internal first catches 28 and 34 are also inaccessible from outside the modular receptacle when the frangible locking member and the modular plug are in place in that modular receptacle. A second catch 29 or 32 on the frangible locking member is adapted to detain the modular plug in the modular receptacle until that frangible locking member has been broken up. Such second catch 29 or 32 may be located between the pair of first catches 28 and 34.

Unlike prior-art structures wherein modular plugs where equipped with a latch-actuating tab 21, such as shown incidentally in FIG. 3, or wherein a latch 13 was otherwise accessible with a tool or other implement, the frangible locking member 20 is shielded against access to its internal first catch 28 or 34 from outside the modular receptacle 12.

Where the frangible locking member 20 is provided with a flexible mount 36 or 37 for its internal first catch 28 or 34, such frangible locking member is shielded against access to such flexible mount from outside the modular receptacle 12. Preferably, the frangible locking member 20 includes shielding structure against access to its internal first catch 28 or catches 28 and 34 or flexible mount or mounts 36 or 37 from outside the modular receptacle.

In this respect, the locking member projection 32 may be seen as a shielding structure, since it not only may act as a second catch, but also prevents access to the first catches 28 and 34 and to their flexible mounts 36 or 37 from below.

Additionally or alternatively, the frangible locking member may be shielded internally or inside of the modular receptacal 12.

Figure 6:
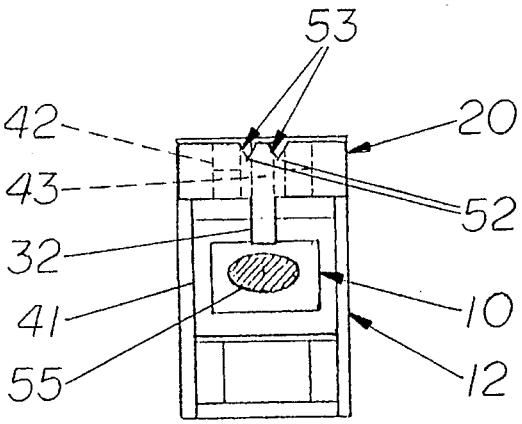
FIG. 6 is a frontal view of the modular connector arrangement shown in FIG. 1, 4 or 5.
Figure 7:
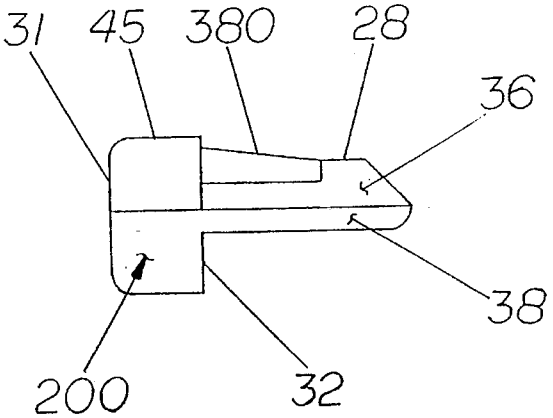
FIG. 7 is a side view of a locking member according to a further embodiment of the invention, that may be used in the modular connector arrangement according to FIGS. 4 to 6 or otherwise within the scope of the invention.

By way of example, FIG. 7 shows a locking member 200 according to a further embodiment of the invention, that may be used in the modular connector arrangement according to FIGS. 4 to 6 or otherwise within the scope of the invention. That locking member 200 includes a shielding structure 380 covering the first catch 28 or first catches 28 and 34 in lateral projection.

In this respect, except for the shielding structure 380, the optional locking member 200 of FIG. 7 may have the same structure as the locking member 20 shown in FIGS. 4 to 6. For example, the shielding structure 380 may be located between the above mentioned pair of internal first catches, and may shield such internal first catches 28 and 34 against acess to their flexible mounts 36 and 37 from anywhere outside the modular receptacle 12.

According to a preferred embodiment of the invention, the shielding structure 380 may be provided by a thickening of the above mentioned third or middle prong 38. In particular, such third or middle prong 38 has a shielding structure 380 covering the catch 28 or 34 on each of the flexible prongs 36 and 37 in lateral projection.

By shielding the catches 28 and 34, the shielding structure 380 also shields the modular receptacle catches 16 and 17 and the releasable interlocking engagements of catches 16 and 28, and 17 and 34, against external intrusion and undoing by pin, penknife, nailfile, miniature screwdriver or other implement or tool.

Typical methods and apparatus according to embodiments of the subject invention are for locking a modular plug 10 in a modular receptacle 12 having a first opening 41 adapted to receive that modular plug, a second opening 42 adjacent that first opening adapted to receive part of the frangible locking member 20 including its internal first catch 28 or catches 28 and 34, and a third opening 43 adjacent that second opening. In that case, the frangible locking member 20 preferably is provided with an upper projection 45 for shielding the upper third opening 43 against access from outside the modular receptacle 12. In practice this prevents people from using pins or other tools or implements for removing a locking member 20 and modular plug 10 undetected for subsequent surreptitious reinsertion of the modular plug with the same locking member.

For instance, where the frangible locking member 20 is provided with one or more flexible mounts 36 for its internal first catch 28 or catches 28 and 34, the locking member head 31 shields such flexible mounts against access from outside of the modular receptacle 12. In the illustrated preferred embodiment of the invention, such shielding is done primarily by the frangible head projection 45 with and without the lower head projection 32 that may act as an external second catch with and without the internal second catch 29.

A preferred embodiment of the invention provides or resides in a device for locking a modular plug 10 in a modular receptacle 12, comprising a locking member 20 disintegral from the modular plug and having a frangible head 31, a pair of spaced flexible prongs or mounts 36 and 37 projecting from such head, a catch 28 or 34 on each of such flexible prongs 36 and 37 spaced from the frangible head 31, and a third prong 38 projecting from such head between the pair of spaced flexible prongs 36 or 37.

Where the catch 28 or 34 on each of the flexible prongs projects in a direction away from the flexible prong 36 or 37 on which that catch is located, the head 31 may project in that direction, such as shown at 45 in FIGS. 1 and 4.

As seen in FIG. 1, 5 and 6, the locking member head 31 may project beyond the flexible prongs 36 and 37 in directions transverse to the direction in which the catch or catches 28 and 34 project away from their flexible mount or prongs 36 and 37. As seen in FIGS. 1, 4 and 6 at 32, the locking member head 31 may project in a direction opposite to the direction in which the catch 28 or 34 on each of the flexible prongs 36 and 37 projects.

According to the illustrated embodiment of the invention, the locking member head 31 projects transversely of prongs 36 and 37 in four directions, such as up, down, right side and left side, thereby thwarting any effort to circumvent by faulty insertion, implement or tool the safety provided by locking members according to the invention.

According to a preferred method of the invention, the modular plug 10 with omitted latch 13 is inserted into the modular receptacle 12 and the locking member 20 is inserted in between such modular plug and modular receptacle, such as shown in FIG. 1 with the aid of arrow 26.

By way of example, the latch-less modular plug 10 may be inserted into the first opening 41 of the modular receptacle 12. The locking member 20 may then be inserted into the second opening 42 of the modular receptacle, at which time the first flexible catch mounts or prongs 36 and 37 may flex as seen in dotted lines in FIG. 4, with the first catches 28 and 34 thus riding under the bosses or internal projections 16 and 17 of the modular receptacle 12. When the catches 28 and 34 have cleared such bosses or projections 16 and 17, the flexible mounts or prongs 36 and 37 snap back, whereby those first catches 28 and 34 catch such projections, such as shown in FIG. 4 at 46. The locking member 20 is thus locked in place and, in turn, effectively locks in place the inserted modular plug 10 as well, such as at 29 and/or 32.

The central third prong 38 lends stability and direction to the locking member, such as by abutting the modular plug 10 while the outer flexible prongs 36 and 37 bend such as indicated in FIG. 4, during insertion of the locking member 20 in between the modular plug 10 and receptacle 12. The central prong also may provide one of the above mentioned second catches 29 restraining the modular plug 10 at 18 against removal from the receptacle 12.

The locking member is frangible; ready to be broken up when desired.

In the preferred embodiment seen in FIGS. 1, 5 and 6, the locking member head 31 is provided with grooves 52 that augment the frangibility of the locking member 20. For instance, a supervisor desiring to remove the modular plug 10 from its receptacle 12 may take a pair or diagonal pliers or other cutting tool broadly symbolized by arrow 53 and may thus break the locking member into three pieces, which may then readily be removed. For instance, the broken-off central portion bearing the central prong 38 may be pulled out and away from the receptacle 12. One of the broken off outer pieces, such as the one bearing the outer prong 36, may then be shifted sideways toward the center, whereby the corresponding catch, such as the catch 28, disengages from its corresponding modular projection, such as projection 16, and can be pulled out, such as in between the modular receptacle projections 16 and 17. The opposite outer first catch 34 may be similarly removed through the central region of and from the modular receptacle 12.

According to a refinement seen in FIGS. 1 and 6, the lower locking member head projection 32 has a width on the order of the width of the central prong 38. In this respect and in general, the cutting grooves 52 of the frangible locking member head may be spaced substantially coincidentally to the spaces between the central prong 38 and the outer prongs 36 and 37. The lower head projection 32 may similarly positioned or dimensioned in width between such spaces or between the grooves 52.

Accordingly, when the frangible member is cut at 52, the modular plug 10 may already be removed when the central prong region 38 of the cut locking member is removed, whereby the outer prong regions 36 and 37 will fall from the second opening 42 into the first opening 41 of the modular receptacle 12 vacated by the removed modular plug 10. In this manner, such broken-off outer prong regions 36 and 37 can easily be removed from the modular plug as well.

The fact that the locking device 20 has to be broken before the modular plug 10 can be removed from its receptacle 12 is an important feature, since it compels an errant operator or other unauthorized person to cut or break the locking device 20 before he or she could surreptitiously remove the modular plug 10 for any of the initially mentioned or other underhanded reasons.

An immediate problem then is that attempts to reinsert a modular plug after the locking device has been broken will be unsuccessful, since there is no locking latch 13 on the modular plug modified as shown in FIG. 2 or otherwise within the scope of the invention. Only persons in possession of an unbroken locking device 20 can successfully reinstall the modified modular plug 10 in the receptacle 12.

Pursuant to a methodology according to an embodiment of the invention, only supervisory personnel or key people are supplied with frangible but unbroken locking devices 20.

This, of course, discourages operators and other personnel from surreptitiously removing any modular plug 10 secured by a locking device 20, since they in effect would have to confess their breach to a supervisor or other key person in order to continue their job on the temporarily disconnected equipment.

Similarly, most intended thieves in hotel rooms and other public-access places are discouraged from stealing a handset or a telephone or other apparatus, if that requires removal of a modular plug 10 that is secured by a locking device 20 according to the subject invention. Most petty thieves are lazy people and are quickly discouraged, if more than a quick move is required to accomplish their nefarious intent.

The subject invention may be practiced with all kinds of modular plugs, for telephone handsets, headsets, apparatuses, recorders, etc., including the well-known standardized modular connectors designated as RJ-11, RJ-14 and RJ-45 connectors. This by way of example, rather than by way of limitation, since the cord 55 connected to the modular plug 10 is intended to be symbolic or all kinds of apparatus cords and apparatuses.

Also, this extensive disclosure will render apparent or suggest to those skilled in the art various modifications and variations within the spirit and scope of the invention.

We claim:

1. Device for locking a modular plug in a modular receptacle, comprising in combination:

a frangible locking member disintegral from said modular plug;

an internal first catch on said frangible locking member adapted to catch an inside of said modular receptacle;

said internal first catch inaccessible from outside said modular receptacle when said frangible locking member and said modular plug are in place in said modular receptacle; and a second catch on said frangible locking member adapted to detain said modular plug in said modular receptacle until said frangible locking member has been broken up.

2. Device as in claim 1, wherein:

said frangible locking member includes shielding structure against access to said internal first catch from outside said modular receptacle.

3. Device as in claim 1, wherein:

said locking member includes a shielding structure covering said catch in lateral projection.

4. Device as in claim 1, wherein:

said frangible locking member includes a flexible mount for said internal first catch.

5. Device as in claim 4, wherein:

said frangible locking member includes shielding structure against access to said flexible mount from outside said modular receptacle.

6. Device as in claim 1, wherein:

said modular receptacle has a first opening adapted to receive said modular plug, a second opening adjacent said first opening adapted to receive part of said frangible locking member including said internal first catch, and a third opening adjacent said second opening; and said frangible locking member including a projection adapted to shield said third opening against access from outside said modular receptacle.

7. Device as in claim 1, wherein:

said modular receptacle has an internal projection;

said internal first catch on said frangible locking member adapted to catch said modular receptacle at said internal projection.

8. Device as in claim 7, wherein:

said frangible locking member includes a flexible mount for said internal first catch.

9. Device as in claim 8, wherein:

said frangible locking member includes shielding structure against access to said flexible mount from outside said modular receptacle.

10. Device as in claim 1, wherein:

said second catch is adapted to block said modular plug from removal from said modular receptacle until said frangible locking member has been broken up.

11. Device as in claim 1, wherein:

said modular plug has a projection; and said second catch is adapted to restrain said modular plug at said projection until said locking member is broken up.

12. Device as in claim 11, wherein:

said second catch is adapted to block said modular plug at said projection from removal from said modular receptacle until said frangible locking member has been broken up.

13. Device as in claim 11, wherein:

said projection is a base for a broken-off locking latch on said modular plug.

14. Device as in claim 1, wherein:

said second catch includes a portion of said-frangible locking member overhanging said modular plug when in said modular receptacle.

15. Device for locking a modular plug in a modular receptacle, comprising in combination:

a frangible locking member disintegral from said modular plug;

a pair of internal first catches on said frangible locking member adapted to catch said modular receptacle inside thereof;

said internal first catches inaccessible from outside said modular receptacle when said frangible locking member and said modular plug are in place in said modular receptacle; and a second catch on said frangible locking member adapted to detain said modular plug in said modular receptacle until said frangible locking member has been broken up.

16. Device as in claim 15, including:

said second catch located between said pair of first catches.

17. Device as in claim 15, wherein:

said frangible locking member includes shielding structure against access to said internal first catches from outside said modular receptacle.

18. Device as in claim 15, wherein:

said frangible locking member includes flexible mounts for said internal first catch.

19. Device as in claim 15, wherein:

said frangible locking member includes shielding structure between said pair of internal first catches against access to said flexible mounts from outside said modular receptacle.

20. Device as in claim 15, wherein:

said modular receptacle has a first opening adapted to receive said modular plug, a second opening adjacent said first opening adapted to receive part of said frangible locking member including said pair of internal first catches, and a third opening adjacent said second opening; and said frangible locking member including a projection adapted to shield said third opening against access from outside said modular receptacle.

21. Device as in claim 15, wherein:

said modular receptacle has a pair of internal projections;

said pair of internal first catches on said frangible locking member adapted to catch said modular receptacle at said pair of internal projections.

22. Device as in claim 21, wherein:

said frangible locking member includes a pair of flexible mounts for said pair of internal first catches.

23. Device as in claim 22, wherein:

said frangible locking member includes shielding structure against access to said flexible mounts from outside said modular receptacle.

24. Device as in claim 15, wherein:

said frangible locking member includes a portion overhanging said modular plug when in said modular receptacle.

25. Device for locking a modular plug in a modular receptacle, comprising in combination:

a locking member disintegral from said modular plug and having a frangible head;

a pair of spaced flexible prongs projecting from said head;

a catch on each of said flexible prongs spaced from said frangible head; and a third prong projecting from said head between said pair of spaced flexible prongs.

26. Device as in claim 25, wherein:

said catch on each of said flexible prongs projects in a direction away from the flexible prong on which that catch is located; and said head projects in said direction.

27. Device as in claim 26, wherein:

said head projects beyond said flexible prongs in directions transverse to said direction.

28. Device as in claim 26, wherein:

said head projects in a direction opposite to said direction in which said catch on each of said flexible prongs projects.

29. Device as in claim 25, wherein:

said head projects transversely of said prongs in four directions.

30. Device as in claim 25, wherein:

said third prong has a shielding structure covering said catch on each of said flexible prongs in lateral projection.

31. Method of locking a modular plug in a modular receptacle, comprising in combination:

providing a frangible locking member disintegral from said modular plug;

providing an internal first catch on said frangible locking member for catching an inside of said modular receptacle;

rendering said internal first catch inaccessible from outside said modular receptacle when said frangible locking member and said modular plug are in place in said modular receptacle;

providing a second catch on said frangible locking member for detaining said modular plug in said modular receptacle until said frangible locking member has been broken up.

32. Method as in claim 31, wherein:

said frangible locking member is shielded against access to said internal first catch from outside said modular receptacle.

33. Method as in claim 32, wherein:

said frangible locking member is provided with a flexible mount for said internal first catch.

34. Method as in claim 33, wherein:

said frangible locking member is shielded inside of said modular receptacle against access to said flexible mount from outside said modular receptacle.

35. Method as in claim 31, for locking a modular plug in a modular receptacle having a first opening adapted to receive said modular plug, a second opening adjacent said first opening adapted to receive part of said frangible locking member including said internal first catch, and a third opening adjacent said second opening, wherein:

said frangible locking member is provided with a projection for shielding said third opening against access from outside said modular receptacle.

36. Method as in claim 31, for locking a modular plug in a modular receptacle having an internal projection, wherein:

said internal first catch on said frangible locking member is provided to catch said modular receptacle at said internal projection.

37. Method as in claim 31, wherein:

said second catch is provided to block said modular plug from removal from said modular receptacle until said frangible locking member has been broken up.

38. Method as in claim 31, for locking a modular plug having a projection in said modular receptacle, wherein:

said second catch is provided to restrain said modular plug at said projection until said locking member is broken up.

39. Method as in claim 31, for use with a standard modular plug of a type manufactured with a resilient latch for catching internal projections in said modular receptacle, said resilient latch having a base integral with that modular plug, wherein:

said standard modular plug is prevented from staying in said modular receptacle without presence of said frangible locking member by omitting said resilient latch from said standard modular plug.

40. Method as in claim 39, wherein:

said resilient latch is omitted from said modular plug at said base of said resilient latch integral with that modular plug.

41. Method as in claim 40, wherein:

said second catch is provided to block said modular plug at said base of said resilient latch integral with that modular plug from removal from said modular receptacle until said frangible locking member has been broken up.

42. Method as in claim 31, wherein:

said frangible locking member is provided with an external portion overhanging said modular plug when in said modular receptacle.

* * * * *